US009803828B2

(12) United States Patent
Lueken et al.

(10) Patent No.: US 9,803,828 B2
(45) Date of Patent: Oct. 31, 2017

(54) PRISMATIC LED MODULE FOR LUMINAIRE

(71) Applicant: Hubbell Incorporated, Shelto, CT (US)

(72) Inventors: Thomas Carl Lueken, Diamond Bar, CA (US); Michael Scott Neuer, Covina, CA (US); Zhijie Chen, Simpsonville, SC (US); Jamey Butteris, Simpsonville, SC (US); Ezekial Thomas Hill, Spartanburg, SC (US)

(73) Assignee: Hubbell Incorporated, Shelton, CT (US)

( * ) Notice: Subject to any disclaimer, the term of this patent is extended or adjusted under 35 U.S.C. 154(b) by 174 days.

(21) Appl. No.: 14/527,508

(22) Filed: Oct. 29, 2014

(65) Prior Publication Data

US 2015/0055342 A1 Feb. 26, 2015

Related U.S. Application Data

(63) Continuation of application No. 13/747,033, filed on Jan. 22, 2013, now Pat. No. 8,888,320.

(Continued)

(51) Int. Cl.

| | |
|---|---|
| ***F21V 29/76*** | (2015.01) |
| ***F21V 5/02*** | (2006.01) |
| ***F21K 9/00*** | (2016.01) |
| ***F21V 17/04*** | (2006.01) |
| ***F21V 23/00*** | (2015.01) |

(Continued)

(52) U.S. Cl.

CPC ..... *F21V 5/02* (2013.01); *F21K 9/00* (2013.01); *F21V 17/04* (2013.01); *F21V 23/005* (2013.01); *F21V 29/2212* (2013.01); *F21V 29/763* (2015.01); *F21K 9/20* (2016.08);

(Continued)

(58) Field of Classification Search

CPC . F21V 5/02; F21V 5/08; F21V 29/503; F21V 29/70; F21V 29/777; F21V 29/763; F21V 29/2212; F21V 17/04; F21V 23/005; G02B 5/04; F21K 9/00

See application file for complete search history.

(56) References Cited

U.S. PATENT DOCUMENTS 6,366,214 B1 * 4/2002 Mitchell ..... B60Q 7/00 315/187
8,888,320 B2 * 11/2014 Lueken ..... F21V 5/02 362/235

(Continued)

*Primary Examiner* — Elmito Breval
*Assistant Examiner* — Nathaniel Lee
(74) *Attorney, Agent, or Firm* — Michael Best & Friedrich, LLP

(57) ABSTRACT

An LED module for a luminaire has a downwardly directed heat sink comprising cooling fins that extend rearward from the module's front end and downward from its top wall, which has a top face that abuts the underside of a luminaire carrier plate. A circuit board carrying at least one LED is mounted on the front face, and a prism is mounted to the heat sink over the LED(s). The front (light-emitting) face of the catadioptric prism has several prominent side-by-side sections which emit beam patterns that diverge laterally and overlap in a central region. A prominent full-width upper section on the front face emits a primarily downwardly directed beam pattern to help fill in dark spots.

16 Claims, 9 Drawing Sheets

Related U.S. Application Data

(60) Provisional application No. 61/591,619, filed on Jan. 27, 2012.

(51) Int. Cl.

| | |
|---|---|
| ***F21V 29/00*** | (2015.01) |
| *F21V 29/70* | (2015.01) |
| *F21V 31/00* | (2006.01) |
| *F21K 9/20* | (2016.01) |
| *F21Y 105/10* | (2016.01) |
| *F21Y 103/10* | (2016.01) |
| *F21Y 115/10* | (2016.01) |

(52) U.S. Cl.
CPC ..... *F21V 31/005* (2013.01); *F21Y 2103/10* (2016.08); *F21Y 2105/10* (2016.08); *F21Y 2115/10* (2016.08)

(56) References Cited

U.S. PATENT DOCUMENTS

| | | | | |
|---|---|---|---|---|
| 2002/0067548 | A1* | 6/2002 | TerHovhannisian ..... | B60Q 1/32 359/627 |
| 2010/0238666 | A1* | 9/2010 | Ominato ..... | G02B 19/0028 362/308 |
| 2011/0013397 | A1* | 1/2011 | Catone ..... | F21S 8/086 362/244 |
| 2011/0228529 | A1* | 9/2011 | Patel ..... | F21V 3/02 362/235 |

* cited by examiner

PRISMATIC LED MODULE FOR LUMINAIRE

CROSS REFERENCE TO RELATED APPLICATIONS

This application claims the benefit of U.S. provisional patent application No. 61/591,619, filed Jan. 27, 2012, which is incorporated by reference herein in its entirety.

FIELD OF THE INVENTION

The invention relates to the field of lighting and concerns luminaires utilizing light emitting diodes (LEDs) for illuminating an area. More particularly, the invention concerns LED modules that can be arrayed in a luminaire to provide a desired level, direction and pattern of illumination.

BACKGROUND

Commonly owned U.S. Pat. No. 8,342,709, which is incorporated by reference herein in its entirety, discloses various arrays of LED modules that snap into relatively large rectangular openings in a luminaire carrier plate. A portion of each module's heat sink extends into the luminaire housing above the carrier plate, and each module has a four-sided reflector that shapes and directs the light emitted by a row of LEDs mounted on a circuit board.

SUMMARY OF THE INVENTION

The LED module of the present invention has a downwardly directed heat sink and is adapted for installation on the underside of a luminaire carrier plate. The heat sink comprises a front end having a front face, a top wall extending rearward from the front end, and a plurality of cooling fins extending rearward from the front end and downward from the top wall. The top wall has a top face for abutting the underside of the luminaire carrier plate. A circuit board carrying at least one LED is mounted on the front face, and a prism is mounted to the heat sink over the LED(s). The top face preferably is disposed at an acute angle to the front face, and the cooling fins preferably taper in height from the front end rearward.

Another aspect of the invention is a catadioptric prism per se for shaping and directing light emitted by an even number of aligned, laterally spaced LEDs. The prism has a transparent body with a fore-and-aft medial vertical plane and comprises a rear light-receiving face, a front light-emitting face, a top face, a bottom face and two side faces. The front face has several prominent sections, as follows. A lower section on each side of the medial vertical plane has a substantially vertical front, and substantially vertical curved sides that merge with the front. A middle section on each side of the medial vertical plane and above the lower section is wider than it is high and has a substantially horizontal rounded face with rounded ends that merge with the rounded face. An upper section, which is above both middle sections, has a downwardly and forwardly slanted surface. The rear face of the prism has a convex cradle section on each side of the medial vertical plane. Each cradle section has at least one pocket behind the middle section of the front face for cradling an LED; and the pockets are symmetrically disposed on opposite sides of the medial vertical plane. The prism preferably is bilaterally symmetrical about the medial vertical plane.

BRIEF DESCRIPTION OF THE DRAWING

Preferred embodiments of the disclosed invention, including the best mode for carrying out the invention, are described in detail below, purely by way of example, with reference to the accompanying drawing figures, in which.

DETAILED DESCRIPTION OF THE INVENTION

Figure 1:
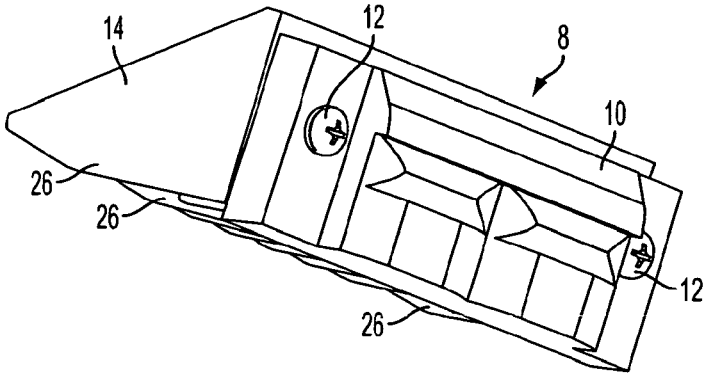
FIG. 1 is a perspective view of an LED module according to the invention, taken from the front and left side thereof.
Figure 2:
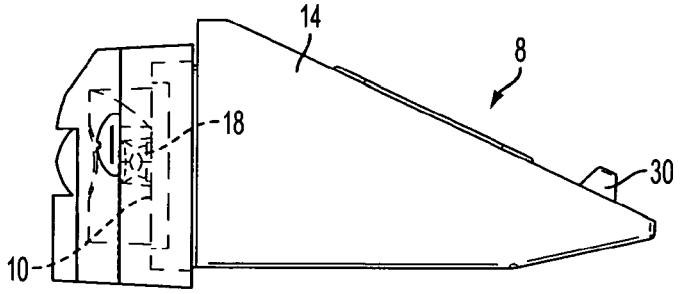
FIG. 2 is a side elevational view thereof.
Figure 3:
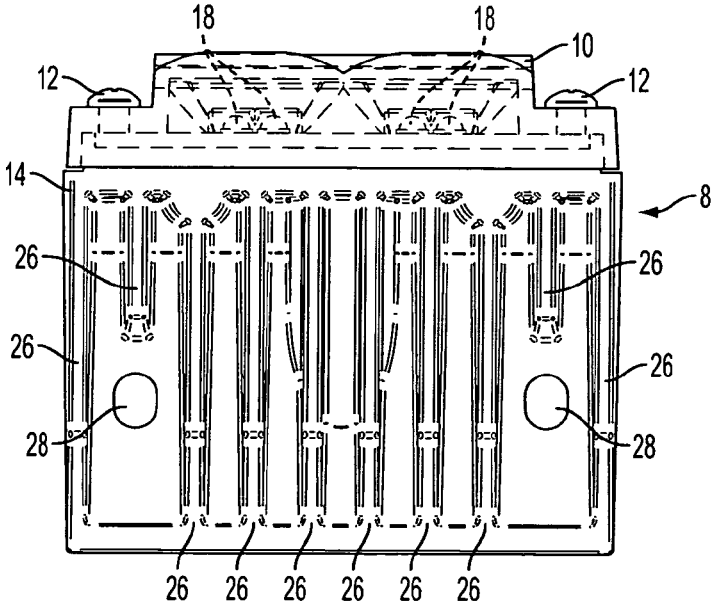
FIG. 3 is a bottom plan view thereof.
Figure 4:
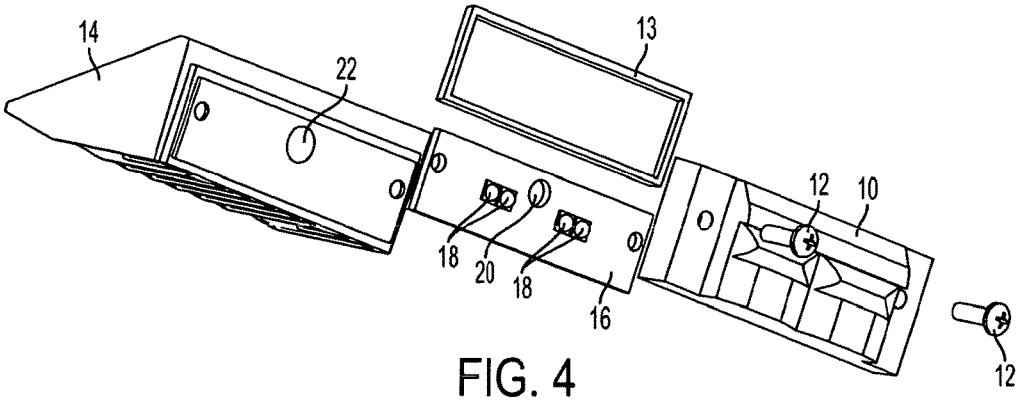
FIG. 4 is an exploded view thereof.
Figure 5:
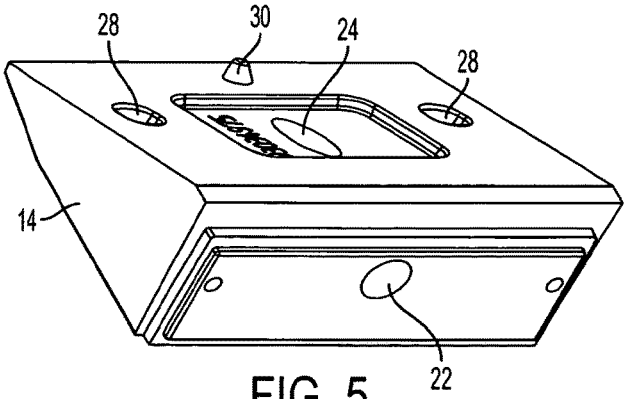
FIG. 5 is a perspective view of the heat sink portion of the module of FIG. 1 taken from the front, top and left side.
Figure 6:
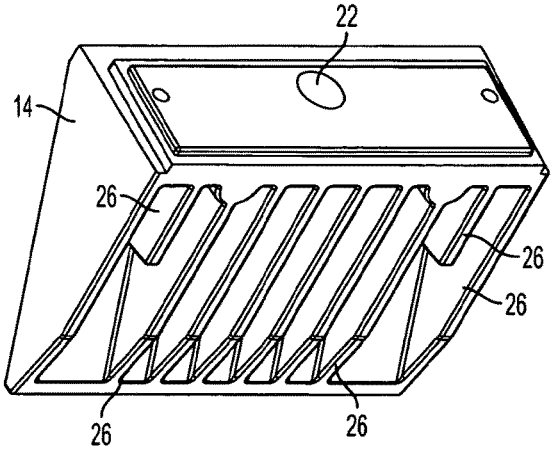
FIG. 6 is a perspective view thereof taken from the front, bottom and left side.

As used in this application, including the claims, terms such as "front," "rear," "side," "top," "bottom," "above," "below," "upward," "downward," "lateral," "vertical" and "horizontal" are used in a relative sense to facilitate the description of the invention, and are not intended to limit the invention to any particular position or orientation except when clearly describing its orientation in an installed, operational position.

Referring to FIGS. 1-6, an exemplary sealed LED module 8 according to the invention comprises an optically clear prism 10 secured by two screws 12 to the front of a wedge-shaped heat sink 14 over a printed circuit board (PCB) 16, which carries four aligned, laterally spaced LEDs 18 symmetrically arranged in two pairs. A thermal paste or other conventional heat transfer medium preferably is interposed between PCB 16 and the front face of heat sink 14. A rectangular gasket 13 is disposed between prism 10 and heat sink 14 to surround and seal PCB 16 from the environment. A hole 20 in PCB 16 and holes 22, 24 in heat sink 14 enable routing of power conductors (not shown) through the heat sink to the PCB.

Heat sink 14 preferably is made of anodized, die cast aluminum and has a series of parallel vertical cooling fins 26 on its underside. The penultimate cooling fin on each side is shortened to make room for a mounting hole 28 in the top wall 29 of the heat sink, which accommodates a mounting screw (not shown) from below for attachment to the carrier plate P of a luminaire (see, e.g., FIGS. 7 and 8). A locating stud 30, which projects upward from the top wall 29, is adapted to register with a mating feature on the carrier plate to ensure proper positioning of the module 8 against the underside of the carrier plate. A rectangular central upper gasket (not shown) forms a seal against the carrier plate around hole 24.

Figure 7:
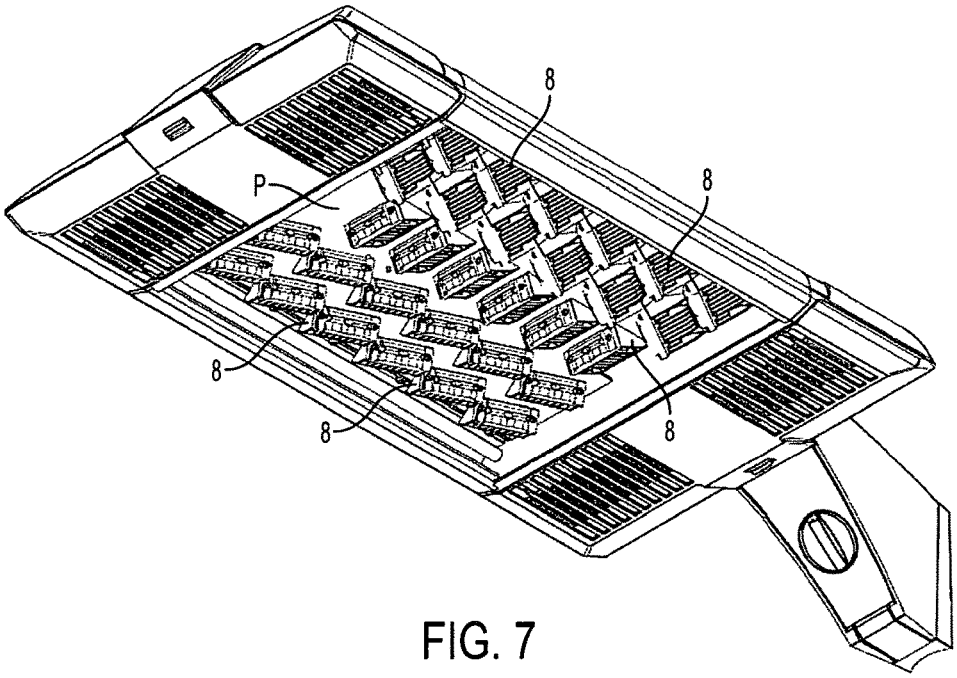
FIG. 7 is a bottom perspective view of a luminaire having a particular array of LED modules according to FIGS. 1-4 installed therein.
Figure 8:
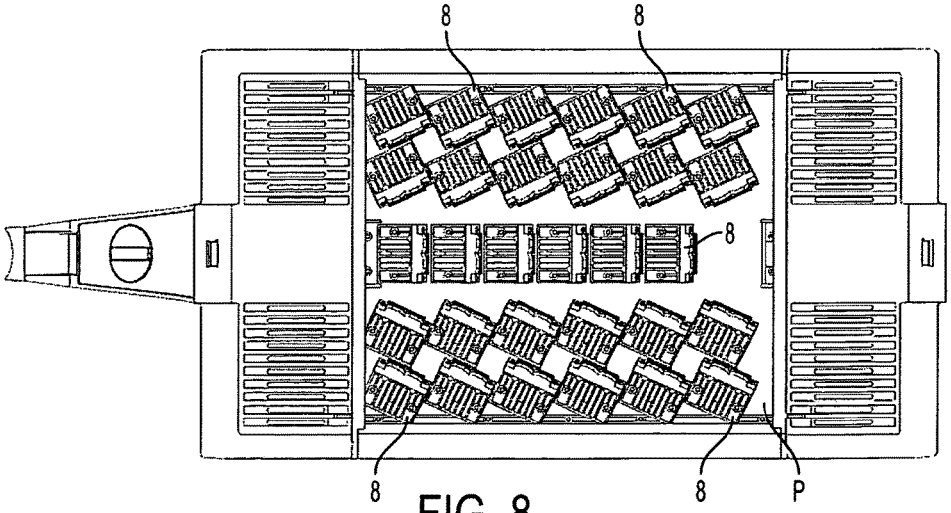
FIG. 8 is a bottom plan view thereof.
Figure 9:
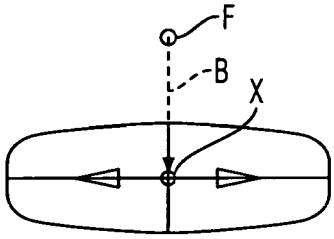
FIGS. 9 through 13 are schematic illustrations of five different light beam patterns producible by five different arrays of LED modules according to the invention.
Figure 10:
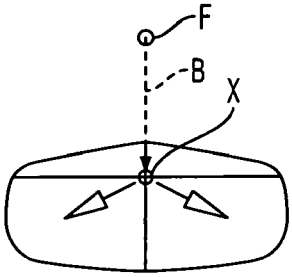
Figure 11:
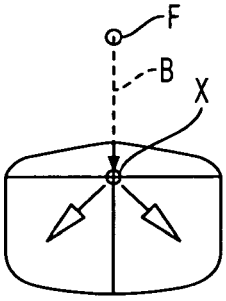
Figure 12:
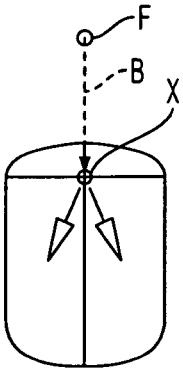
Figure 13:
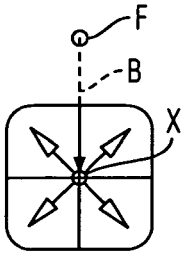
Figure 15:
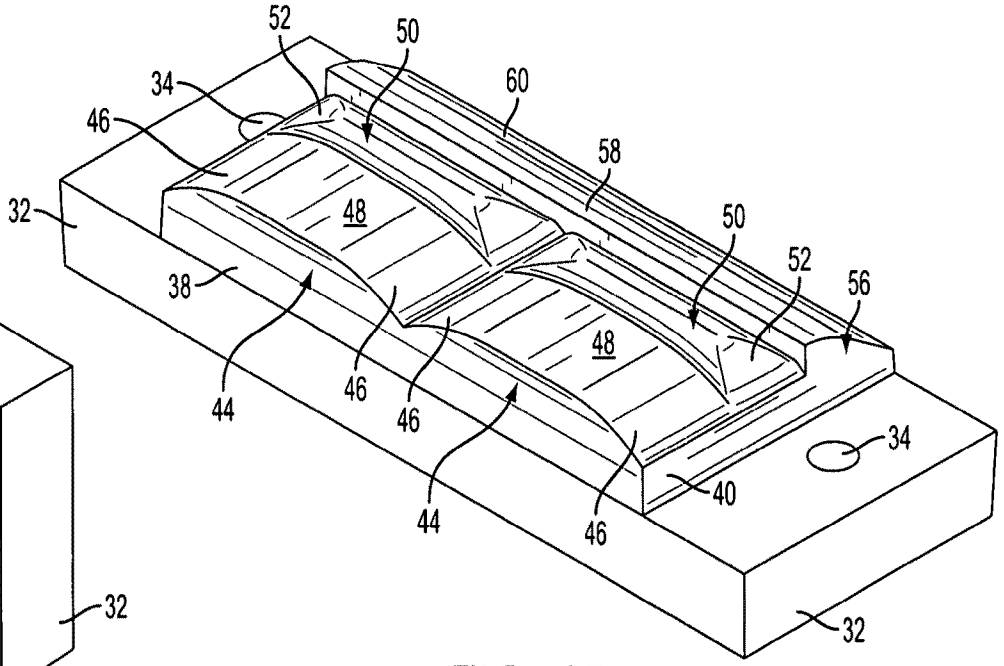
FIG. 15 is a perspective view thereof taken from the front, bottom and right side.
Figure 14:
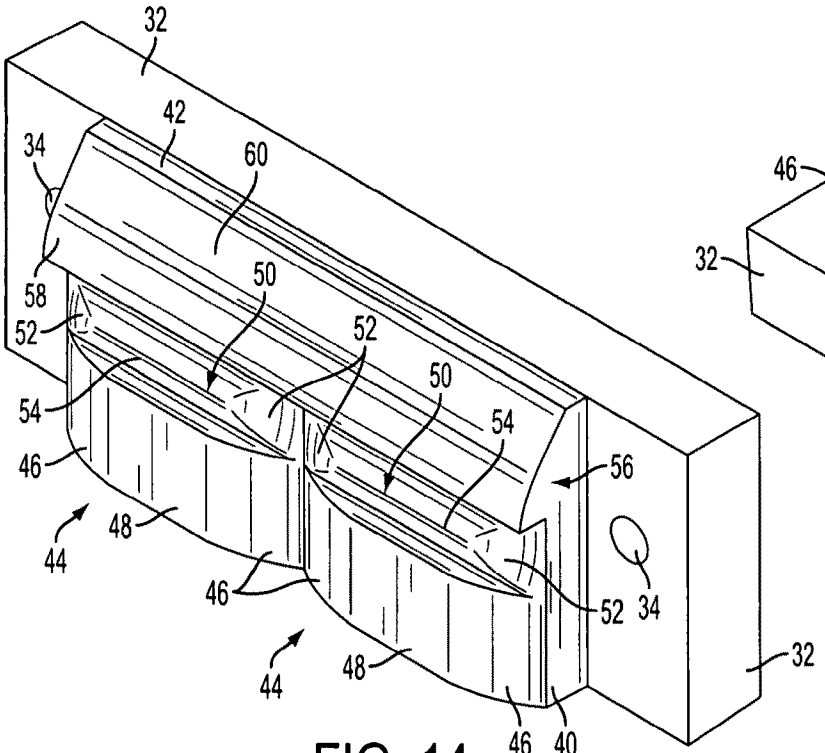
FIG. 14 is a perspective view of a prism of the invention taken from the front, top and right side thereof.
Figure 17:
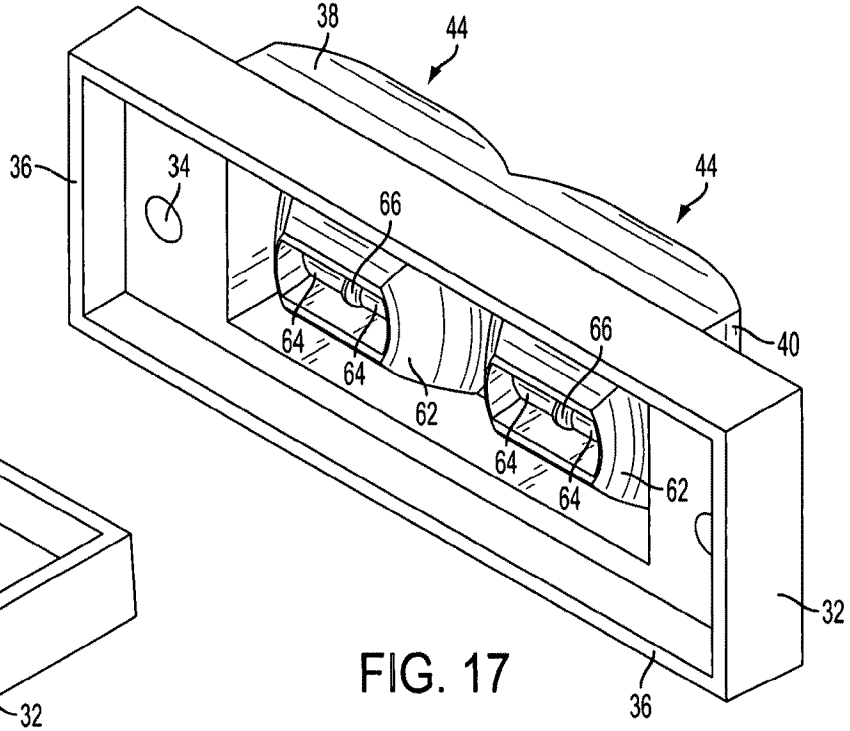
FIG. 17 is a perspective view thereof taken from the rear, bottom and right side.
Figure 16:
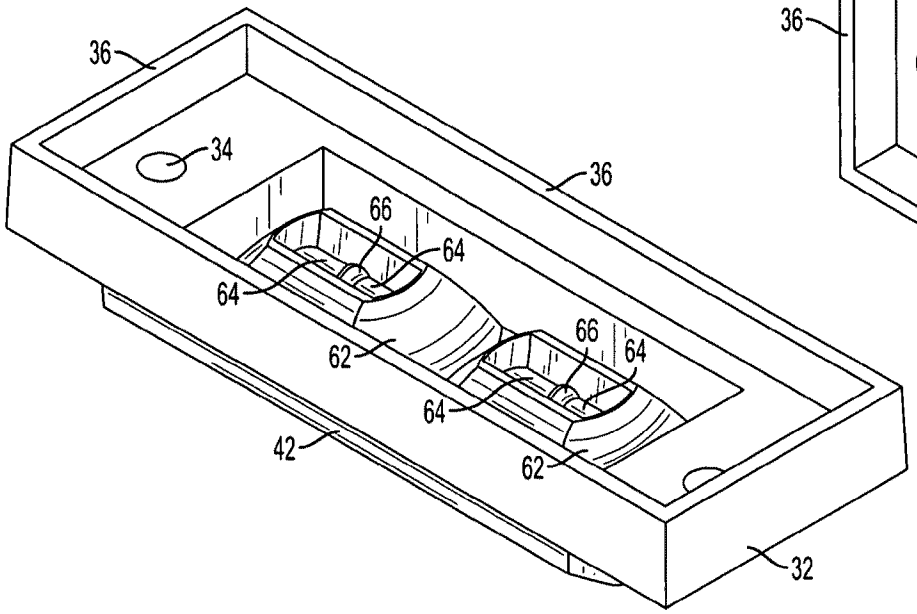
FIG. 16 is a perspective view thereof taken from the rear, top and right side.
Figure 18:
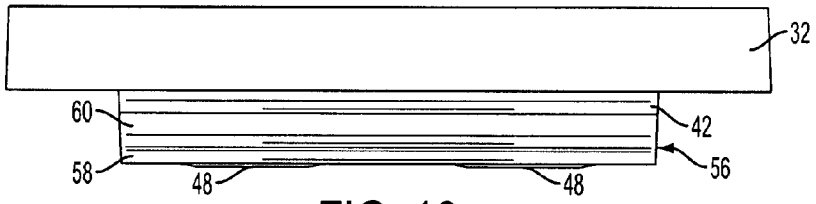
FIG. 18 is a top plan view thereof.
Figure 19:
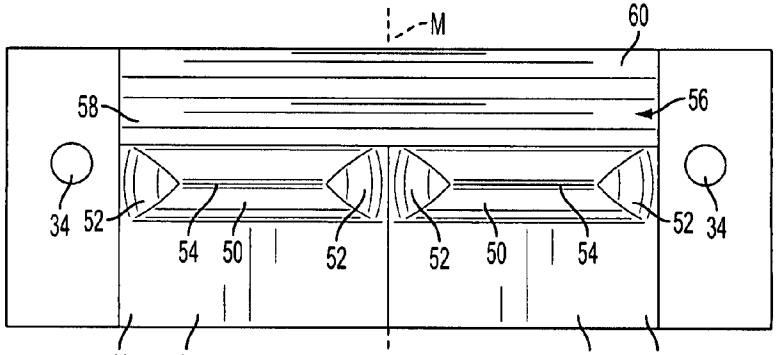
FIG. 19 is a front elevational view thereof.
Figure 20:
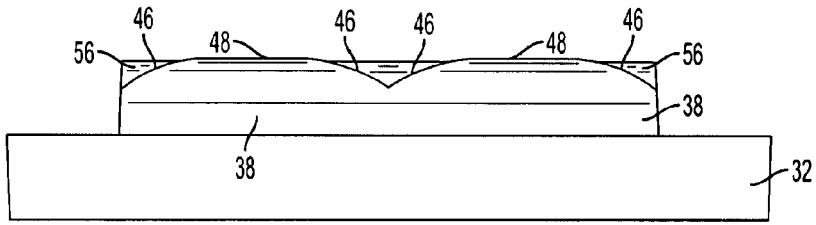
FIG. 20 is a bottom plan view thereof.
Figure 21:
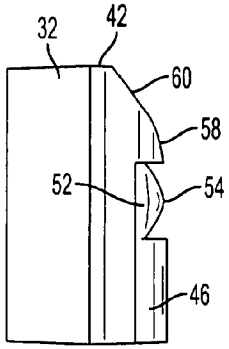
FIG. 21 is a right-side elevational view thereof.
Figure 22:
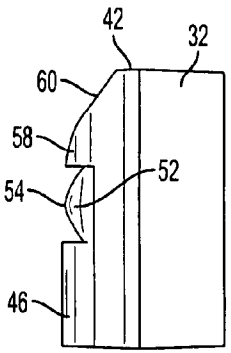
FIG. 22 is a left-side elevational view thereof.
Figure 26:
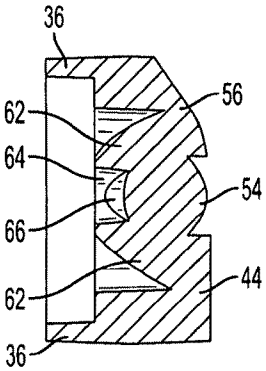
FIG. 26 is a cross-sectional view thereof taken along line 26-26 in FIG. 23.
Figure 24:
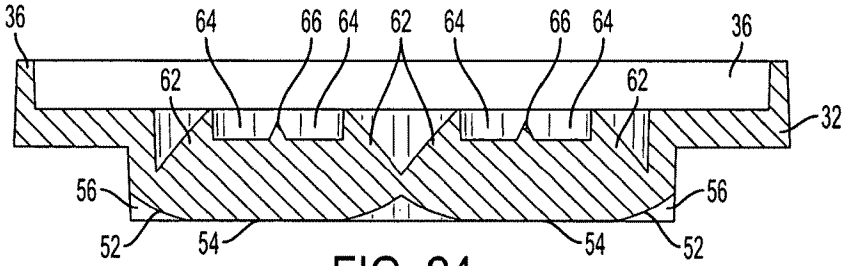
FIG. 24 is a cross-sectional view thereof taken along line 24-24 in FIG. 23.

The array of LED modules 8 shown in FIGS. 7 and 8 comprises a center row of six forward-facing modules flanked on each side by twelve modules (in two rows of six modules each) that face obliquely toward the center row. Other arrays of modules may be used to provide desired patterns of illumination. For example, U.S. Pat. No. 8,342,709 discloses five exemplary arrays of LED modules mounted to a luminaire carrier plate to produce the five different patterns shown in FIGS. 18-22 thereof. FIGS. 9-13 herein are substantial reproductions of those figures and show that the same types of patterns can be produced by arrays of modules 8 according to the present invention from a luminaire F projecting a light beam B generally along an optical axis X (the axis corresponding to the maximum candlepower). Those patterns substantially correspond to the beam shapes specified in IES NEMA regulations as Type I (FIG. 9); Type II (FIG. 10); Type III (FIG. 11); Type IV (FIG. 12); and Type V (FIG. 13). The module array of FIGS. 7 and 8 will produce a Type 3 beam shape.

Figure 27:
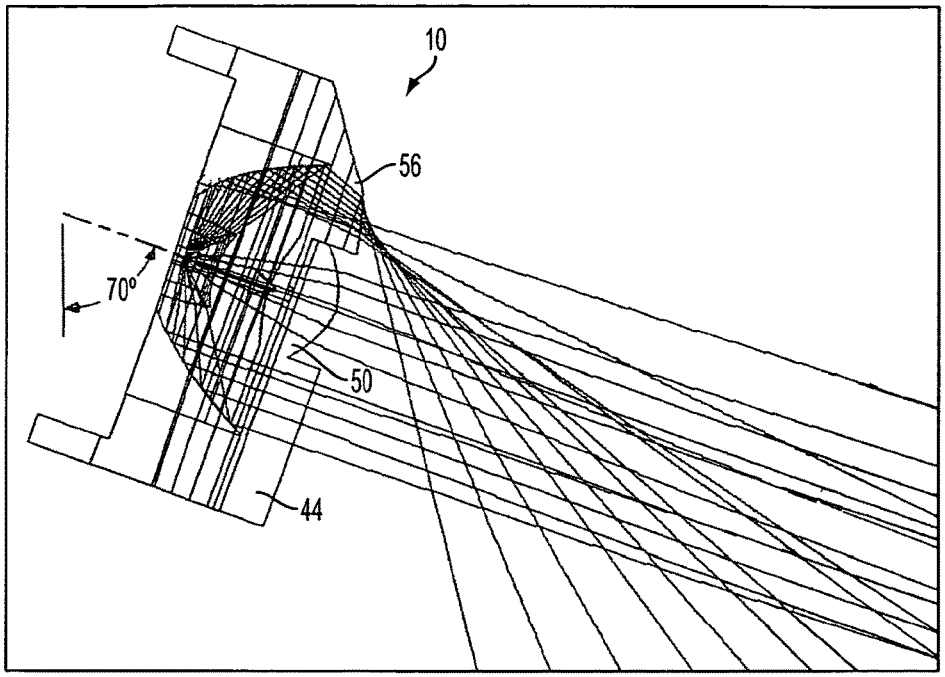
FIG. 27 is a left-side elevational view thereof showing LED light ray traces reflecting, refracting and emanating from the left half thereof.
Figure 28:
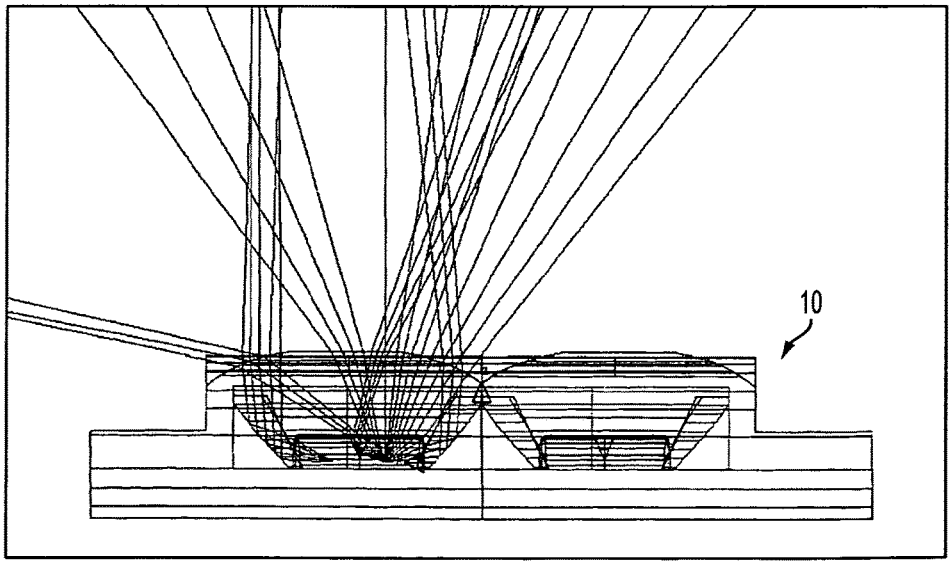
FIG. 28 is a top plan view thereof showing LED light ray traces reflecting, refracting and emanating from the right half thereof.

Due to the slant of heat sink top wall 29, prism 10 will face obliquely downward when the LED module is mounted to a substantially horizontal luminaire carrier plate. That orientation and the optical characteristics of the prism 10 (described below) will cause the optical axis X to meet a substantially horizontal surface to be illuminated at an angle of approximately 60° to 80° off vertical, preferably about 65° to 70° off vertical as shown in FIG. 27. This generally will be the situation regardless of luminaire mounting height. FIG. 1 of U.S. Pat. No. 8,342,709 schematically illustrates this geometry. As roughly illustrated by the ray traces in FIGS. 27 and 28 herein, about 95% of the main beam intensity will be within about a 10° to 12° vertical spread by about a 30° to 40° horizontal spread, and about 5% of the beam intensity will be aimed downward at about 20° to 25° off vertical to help fill dark spots below the luminaire. For the sake of simplicity, FIG. 28 shows the ray traces of only one side of prism 10. The ray traces of the other side of the prism are the mirror image of those shown, with beam overlap in the central region.

Figure 23:
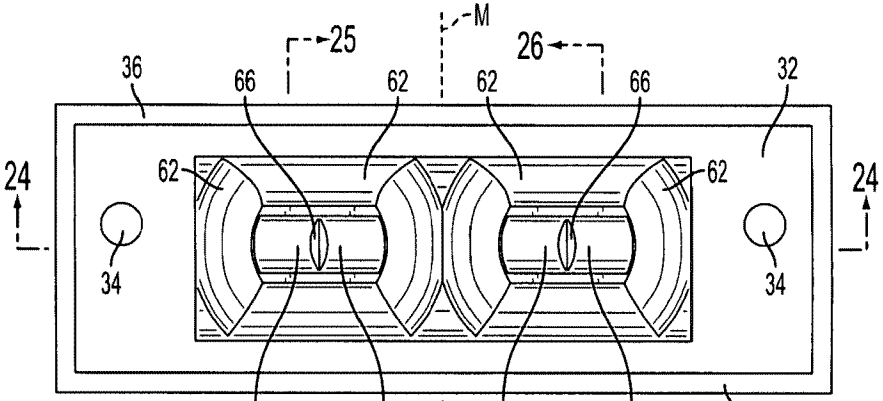
FIG. 23 is a rear elevational view thereof.
Figure 25:
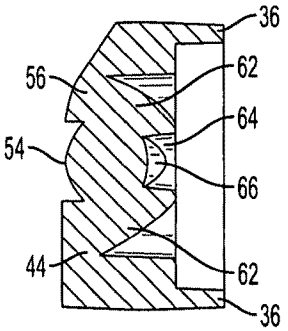
FIG. 25 is a cross-sectional view thereof taken along line 25-25 in FIG. 23.

Prism 10 preferably is molded of a UV stabilized, optically clear acrylic thermoplastic material having a refractive index of about 1.49. Other materials may be used instead, for example, glass or polycarbonate. The optical surfaces preferably have a class A polish to maximize internal reflections. FIGS. 14-28 show the physical features of the prism, which is bilaterally symmetrical about its fore-and-aft medial vertical plane M (see FIGS. 19 and 23) and includes a hollow rectangular mounting base 32 having mounting holes 34 and a peripheral flange 36 that surrounds PCB 16. The light-shaping portions of prism 10, which are integrally formed with base 32, are situated centrally and mostly forward of flange 36 and have a flat bottom 38, flat sides 40 and a flat top 42.

At the front of prism 10 on each side of the medial vertical plane, at the bottom, is a bulging "breakfront" portion 44 having curved vertical sides 46 and a substantially flat, vertical front face 48. Above breakfront portion 44 is a horizontal "semi-tubular" portion 50 with rounded ends 52 and a rounded face 54, which has a radius of curvature that tightens toward its horizontal center. Above semi-tubular portion 50 is a horizontal "forehead" bar 56 that spans both sides and has a slightly slanted "brow" portion 58, which gradually transitions to a flat, more slanted "crown" portion 60. At the rear of prism 10 on each side of the medial vertical plane is a convex, horizontally elongated "cradle" portion 62, which has two side-by-side pockets (recesses) 64 separated by a vertical rib 66. Each pocket 64 cradles an LED 18 (see FIGS. 2 and 3). As seen in FIG. 27, it is forehead bar 56 that directs the small portion (about 5%) of the beam intensity downward to help fill dark spots below the luminaire.

While exemplary embodiments have been chosen to illustrate the invention, it will be understood by those skilled in the art that various changes, modifications, additions, and substitutions are possible, without departing from the scope and spirit of the invention.

What is claimed is:

1. A luminaire comprising:

a housing having a top portion and a bottom portion, said bottom portion including a carrier plate;

a plurality of lighting modules each including a metallic heat sink with a flat upper wall abutting said carrier plate, a front face adjacent said upper wall and two or more parallel cooling fins disposed below and perpendicular to said flat upper wall and said front face, wherein said flat upper wall of said plurality of lighting modules is disposed at an acute angle to said front face.

2. The luminaire of claim 1, wherein said plurality of lighting modules each further include, a circuit board disposed on said front face and carrying at least one light emitting diode (LED), and a prism disposed on said heat sink over said at least one LED.

3. The luminaire of claim 1, wherein said heat sink is a single unitary piece.

4. The luminaire of claim 1, wherein said bottom portion includes a single carrier plate.

5. The luminaire of claim 1, wherein said flat upper wall of said plurality of lighting modules has at least one opening for accommodating a fastener to secure the module to said carrier plate of said housing.

6. The luminaire of claim 1, wherein said plurality of lighting modules each includes at least one locating stud for engaging a corresponding recess in said carrier plate.

7. The luminaire of claim 2, wherein said plurality of lighting modules each further includes a sealing gasket disposed between said prism and said front face and surrounding said circuit board.

8. The luminaire of claim 2, wherein each prism includes a hollow mounting base having a flange surrounding a corresponding one of said circuit boards.

9. The luminaire of claim 2, wherein said cooling fins of each of said lighting modules taper in height from said front face rearward.

10. The luminaire of claim 2, wherein said at least one LED comprises an even number of aligned LEDs arranged in two laterally spaced groups disposed on either side of a hole in said front face.

11. The luminaire of claim 2, wherein said plurality of lighting modules comprises at least three separate groups of modules, each group including a plurality of lighting modules each module directing light in the same direction as the other modules in its respective group.

12. The luminaire of claim 11, wherein said at least three separate groups of modules includes a first group having a plurality of modules each directing light away from said carrier plate and towards a front of said housing, a second group having a plurality of modules each directing light away from said carrier plate and towards a front of said housing and a first side of said housing and a third group having a plurality of modules each directing light away from said carrier plate and towards a front of said housing and a second side of said housing.

13. The luminaire of claim 12, wherein the modules of said first group of lighting modules are disposed in a single line on a center line of said carrier plate.

14. The luminaire of claim 13, wherein the modules of said second and third groups of lighting modules are disposed at an acute angle to said center line of said carrier plate.

15. The luminaire of claim 2, wherein each of said prisms is a catadioptric prism for shaping and directing light emitted by said at least one LED.

16. The luminaire of claim 15, wherein each catadioptric prism includes:

a rear light-receiving face;
a front light-emitting face;
a top face;
a bottom face; and
two side faces, said front light-emitting face including, a prominent lower section on each side of said medial vertical plane, each lower section having a substantially vertical front and substantially vertical curved sides and that merge with said front;

a prominent middle section above each lower section, the width of each middle section being greater than its height, each middle section having a substantially horizontal rounded face and rounded ends that merge with said rounded face; and a prominent upper section above both of said middle sections, said upper section having a downwardly and forwardly slanted surface, and said rear face including a convex cradle section on each side of said medial vertical plane, each cradle section having at least one pocket behind said middle section of said front face for cradling an LED, said pockets being symmetrically disposed on opposite sides of said medial vertical plane.

* * * * *